US007415744B1

(12) United States Patent
Williams

(10) Patent No.: US 7,415,744 B1
(45) Date of Patent: Aug. 26, 2008

(54) MULTIPURPOSE FOLDABLE CANDLE TOOL

(76) Inventor: Scott G. Williams, 200 E. Railroad St., Pottsville, PA (US) 17901

( * ) Notice: Subject to any disclaimer, the term of this patent is extended or adjusted under 35 U.S.C. 154(b) by 1308 days.

(21) Appl. No.: 10/051,488

(22) Filed: Jan. 18, 2002

(51) Int. Cl.
*B25B 7/22* (2006.01)

(52) U.S. Cl. ..... 7/128; 7/125

(58) Field of Classification Search ..... 7/128, 7/127, 125, 129, 118, 167, 168
See application file for complete search history.

(56) References Cited

U.S. PATENT DOCUMENTS 1,047,795 A * 12/1912 Gross ..... 7/118
1,204,676 A * 11/1916 Machuga ..... 7/118
2,074,640 A * 3/1937 Christy ..... 30/162
2,496,840 A * 2/1950 Alexander ..... 431/202
2,575,652 A 11/1951 Bovee
2,828,855 A 4/1958 Mosch
4,204,294 A * 5/1980 Halverson ..... 15/185
4,238,862 A 12/1980 Leatherman
4,600,022 A 7/1986 Pierce, Jr.
4,842,132 A * 6/1989 Wells ..... 206/229
4,882,841 A * 11/1989 Margolis ..... 30/125
5,553,340 A * 9/1996 Brown, Jr. ..... 7/118
5,743,582 A 4/1998 Rivera
5,826,338 A 10/1998 Chilton et al.
5,993,560 A * 11/1999 Wasak et al. ..... 134/6
D429,989 S 8/2000 Rivera
6,108,845 A 8/2000 Hung et al.
6,142,769 A * 11/2000 Walker ..... 431/253
6,185,778 B1 * 2/2001 Ornstedt ..... 15/114
6,289,768 B1 9/2001 Anderson et al.
6,293,018 B1 9/2001 Rivera

* cited by examiner

*Primary Examiner*—Hadi Shakeri
(74) *Attorney, Agent, or Firm*—Coats & Bennett, P.L.L.C.

(57) ABSTRACT

A foldable candle tool is presented that includes a pair of handles with each handle having an open channel. A wick cutter having a pair of jaws pivotally connected about a pivot pin and includes a pair of legs with each leg being pivotally connected to one end of one handle such that the handles are effectively coupled together by the wick cutter. Further, the handles are moveable between a closed position and an open position. In the closed position, the open channels of each handle face each other and the wick cutter is at least partially housed within the channels. A plurality of additional candle tools are moveably mounted to the handles with each additional candle tool being moveable from a stored position within one channel to a position where the candle tool projects outwardly from the channel.

18 Claims, 4 Drawing Sheets

MULTIPURPOSE FOLDABLE CANDLE TOOL

FIELD OF THE INVENTION

The present invention relates to candle tools for performing work and tasks relating to lighting and maintaining candles, and more particularly to a foldable multipurpose candle tool.

BACKGROUND OF THE INVENTION

Candles are widely used by millions of people all over the world. While candles come in many sizes, shapes, and types, many of the larger and more expensive candles require ongoing maintenance. Further, the same candles must be lit and extinguished from time to time. Therefore, there has been and continues to be a need for a multipurpose candle tool that will provide a wide variety of candle maintenance functions and which can be used to light and extinguish the wick of the candle.

SUMMARY OF THE INVENTION

The present invention relates to a foldable candle tool having incorporated into the tool a plurality of individual tools for performing tasks or functions relating to a candle. The foldable candle tool comprises a foldable handle structure that is movable between a folded and closed position and an open and operative position. A series of individual candle tools are movably mounted to the foldable handle structure with each tool being movable from a storage position contained within the handle to an open and operative position where the particular tool projects from the handle structure.

In a particular embodiment of the present invention, the candle tool includes a pair of handles with each handle having an open channel formed therein. A wick cutter is mounted to the ends of the pair of handles. The wick cutter includes a pair of jaws pivotally connected about a pivot pin and further includes a pair of legs or arms. Each of the legs of the wick cutter is pivotally connected to one end of one handle such that the handles are effectively coupled together by the wick cutter. The handles are moveable between a closed position where the open channels of each handle face each other and the wick cutter is at least partially housed within the opposed channels, and an open position where the wick cutter projects from the two handles. Finally, a plurality of candle tools are movably mounted to the handles with each candle tool being moveable from a stored position within one channel to a position where the candle tool projects outwardly from the handle.

Any number or type of candle tool can be incorporated into the multipurpose candle tool of the present invention. For example, the candle tool may include one or more of the following tools: wick cutter, wick dipper, match holder, scoop, digger, pre-fueled lighter, wick lighter or an extendable swab.

Other objects and advantages of the present invention will become apparent and obvious from a study of the following description and the accompanying drawings which are merely illustrative of such invention.

DESCRIPTION OF EXEMPLARY EMBODIMENT

Figure 1:
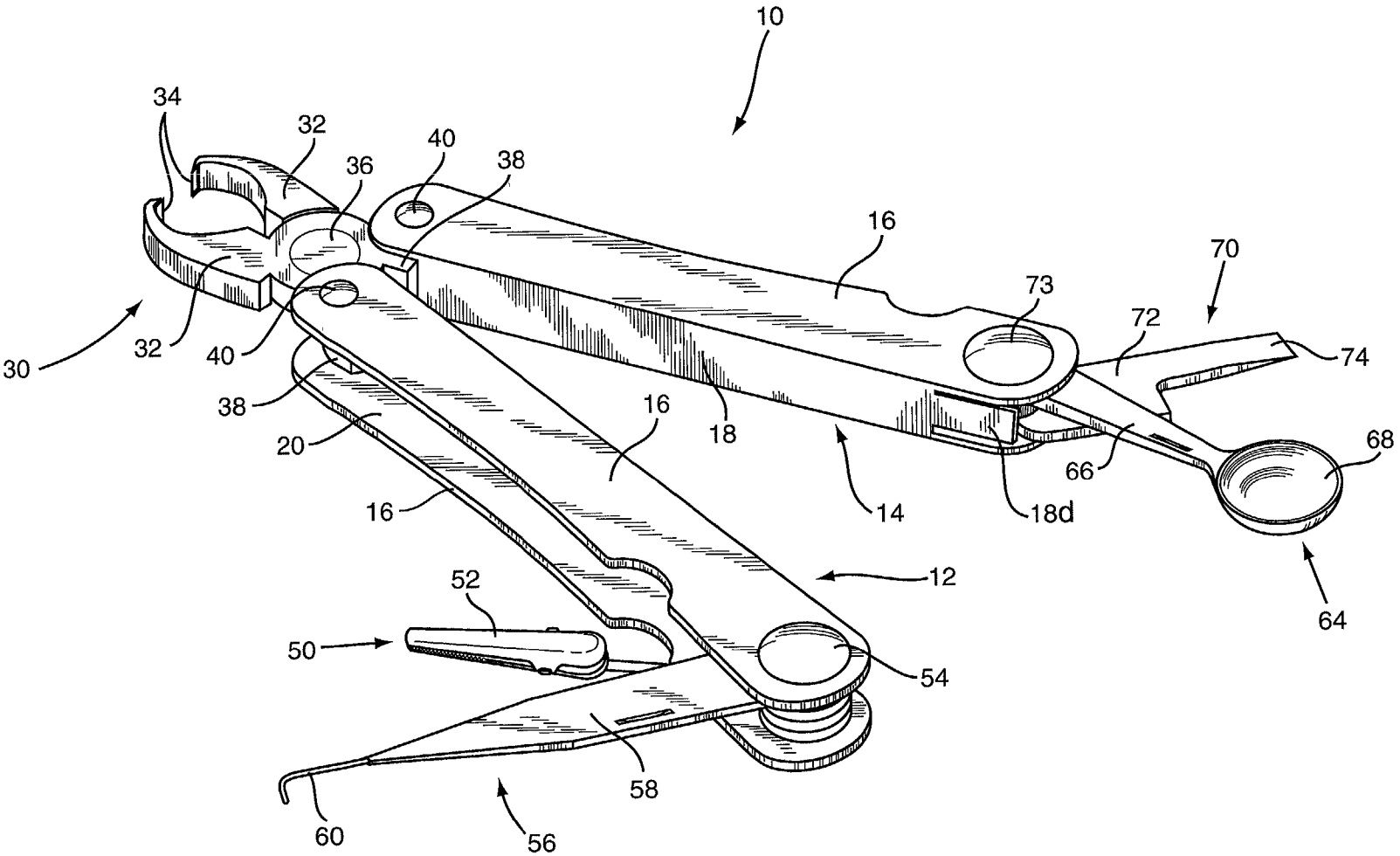
FIG. 1 is a perspective view of the candle tool of the present invention.

With further reference to the drawings, particularly FIG. 1, the candle tool of the present invention is shown therein and indicated generally by the numeral 10. Candle tool 10 comprises two handles, handle 12 and handle 14. Each handle includes a pair of opposed sides 16 and a back 18. Back 18, about the terminal end of each handle, includes a deflectable tab or flap 18*d*. The significance of this deflectable tab or flap 18*d* will be discussed subsequently herein. In any event, there is formed an open channel 20 in each handle 12 and 14. As will be appreciated from subsequent portions of this disclosure, the open channel 20 enables a number of individual candle tools to be stored therein when the handle tool 10 is not being used.

Joining the two handles together is a wick cutter indicated generally by the numeral 30. Wick cutter 30 includes a pair of jaws 32. Jaws 32 include a pair of opposed cutting edges 34. Further, jaws 32 are pivotally connected about a pivot pin 36. Finally, the jaws include a pair of legs or arms 38 that extend past the pivot pin 36 and are pivotally connected to one end of each of the handles 12 and 14 by pins 40.

The candle tool 10 includes a plurality or series of other candle tools. These tools are pivotally connected to the end of each handle 12 and 14 opposite the ends where the wick cutter is attached.

With reference to these additional candle tools, there is provided a match holder indicated generally by the numeral 50. Match holder 50 comprises an alligator clip 52 that is pivotally connected to one end of handle 12 via pivot shaft 54. Note that provided on pivot shaft 54 between the sides 16 are a series of spacer rings. These spacer rings are utilized to occupy space between the sides 16 of the handle and to effectively frictionally hold the individual tools within the handles but yet enable the tools to turn against the friction created.

Also, pivotally connected on pivot shaft 54 is a wick dipper indicated generally by the numeral 56. Wick dipper 56 includes an arm that is pivotally mounted about pivot shaft 54 and which extends outwardly therefrom. Secured to the terminal end of the arm 58 is an L-shaped generally rigid wire 60.

Now turning to the other handle 14, this handle includes a scoop indicated generally by the numeral 64. Scoop 64 includes an arm 66 that is pivotally mounted on shaft 73. Shaft 73 like pivot pin or shaft 54, could include a series of rings interposed between the respective tools. In any event, formed on the terminal end of arm 66 is a scoop 68.

Another candle tool secured to handle 14 is a digger or blade 70. As shown in FIG. 1, the digger 70 includes a blade portion 72 and a tapered tip 74.

Figure 3A:
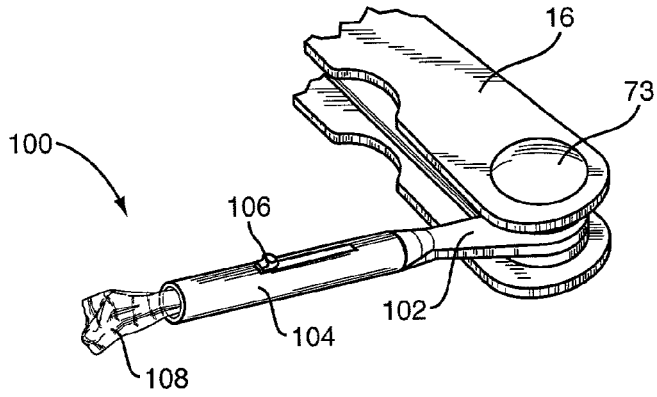
FIG. 3A is a fragmentary perspective view showing an alternate embodiment of the candle tool.

FIGS. 3A-3O show various other candle tools that can be incorporated into the candle tool 10 of the present invention. With respect to FIG. 3C, there is shown therein a pre-fueled lighter indicated generally by the numeral 80. Essentially, the pre-fueled lighter 80 would include a device such as a small butane lighter that would be used to light the wick of a candle. Again, this tool, like the other tools discussed above, would be pivotally mounted to one of the handles 12 or 14 and would be rotatable or moveable from a stored position within an individual channel 20 and an open or operative position where the tool extends from the handle such as shown in FIG. 3C.

Figure 3B:
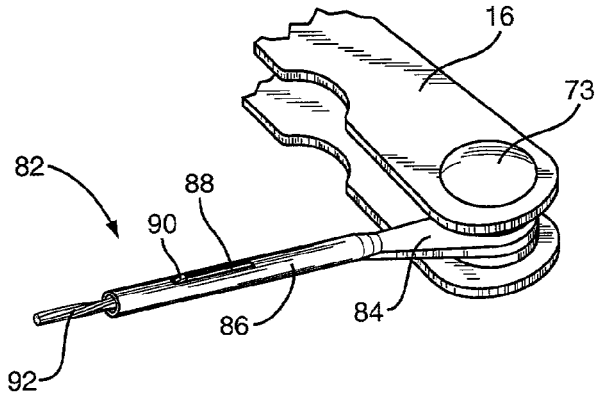
FIG. 3B is a fragmentary perspective view showing another alternative embodiment of the candle tool.
Figure 3C:
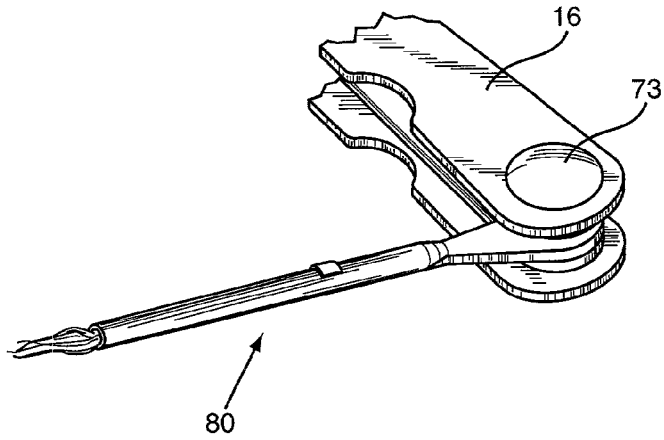
FIG. 3C is another fragmentary perspective view showing yet another alternative embodiment of the candle tool.

FIG. 3B illustrates a wick lighter. The wick lighter is indicated generally by the numeral 82 and includes a pivot arm 84 that in this case is pivotally mounted about pivot pin or shaft 73. Wick lighter 82 includes a sleeve 86. Sleeve 86 includes an elongated slot 88. Mounted within the elongated slot is a thumb carrier 90. The thumb carrier 90 is operatively connected with a wick 92 contained within the sleeve 86. By moving the thumb carrier 90 back and forth within slot 86, it is appreciated that the wick 92 can be moved from a retracted position within the sleeve to an extended position. In the extended position, the wick 92 can be lit and used to light a wick of a candle.

Turning to FIG. 3A, there is shown therein a candle tool that is referred to as a "swab tool" and indicated generally by the numeral 100. This tool includes an arm 102 that is pivotally connected to pivot pin 73. A sleeve 104 extends from arm 102. There is also provided a slot in the sleeve 104 and a thumb carrier 106 is slideably mounted within the slide. Contained within the sleeve is a disposable swab 108. The thumb carrier 106 would be provided with a spike or other device that projects into the swab 108. By moving the thumb carrier 106 back and forth within the slot in the sleeve 104, the swab 108 can be moved from a retracted position within the sleeve to an extended position. In the extended position, the swab can be projected into or extended into melted wax to absorb and remove the same from in and around the wick of the candle.

As already discussed, each of the individual tools are designed to be stored or housed within the channels 20 of the handles 12 and 14. However, each of the tools can be moved from a stored or housed position to an operative position where they project out from the handles 12 and 14 in order that they can be efficiently used.

Figure 4A:
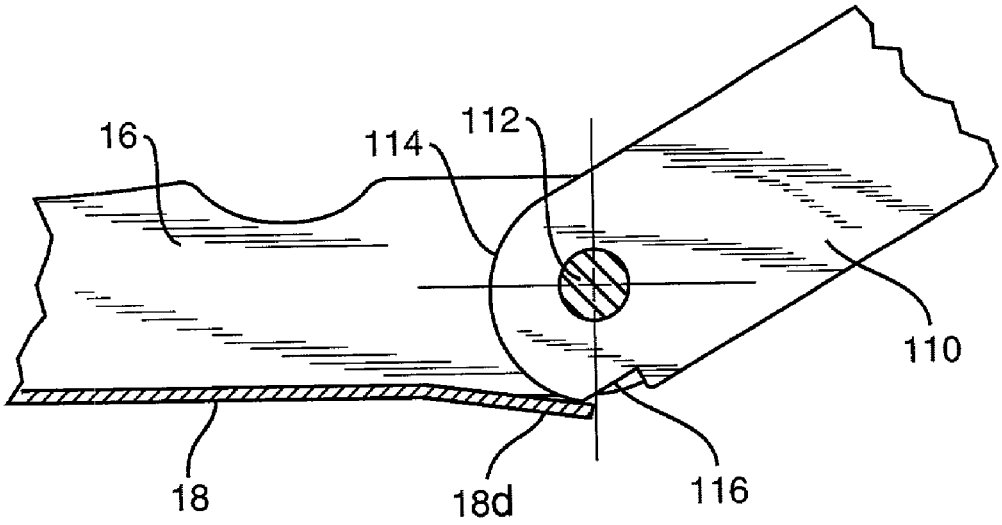
FIGS. 4A and 4B are schematic illustrations of a detent mechanism incorporated into the candle tool of the present invention.
Figure 4B:
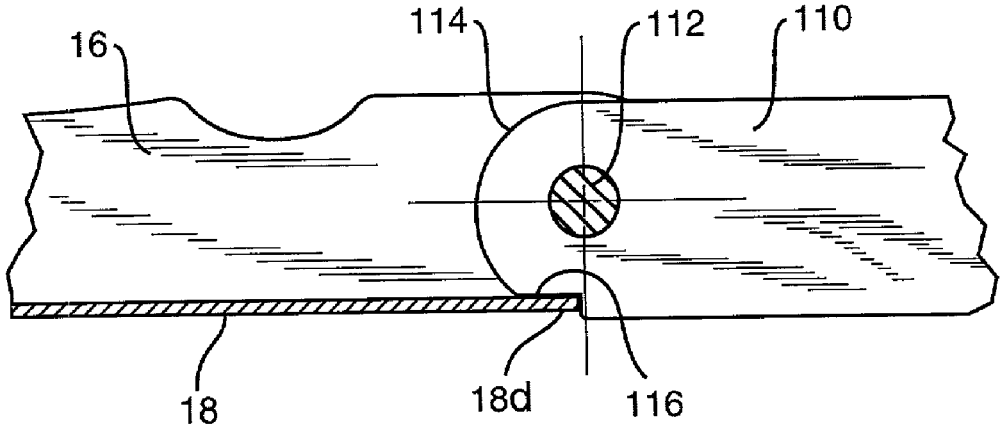

It is desirable to provide a mechanism that enables each of the tools to move into a secure and stable position when the tool assumes the open or operative position. Thus, it is desirable to provide a mechanism, such as a detent mechanism, for enabling the individual tools to snap into a stable and secure operative position. Such a detent mechanism is shown in FIGS. 4A and 4B. It should be appreciated that other mechanisms and designs can be provided to yield the same results. In any event, with respect to FIGS. 4A and 4B, it is seen that a tool arm 110 is pivotally mounted to the sides 16 of a handle through a pivot shaft 112. Tool arm 110 includes a radius end 114 that extends into a detent or slot 116. As discussed earlier, the back 18 of each handle includes a back tab or flap extension 18*d*. This flap extension 18*d* is slightly bendable or flexible. The tool arm 110 can be designed and spaced such that as the tool arm 110 is rotated clockwise as viewed in FIG. 4A towards an open position, the radius end 114 of the tool arm will engage the tab or flap extension 18*d* and will slightly deflect the same as a tool arm turns. However, as the tool arm reaches the home position or the operative position, the tab or flap extension 18*d* will flip into engagement with the detent or slot 116. This will effectively secure and hold the tool arm in a secure and stable operative position. Further, when the tool arm is rotated counterclockwise as viewed in FIGS. 4A and 4B, towards the stored or inoperative position, the radius end 114 will engage the tab or flap extension 18*d* and slightly deflect the same as the tool arm turns back to the stored or inoperative position. Again, as expressed above, various other well-known designs can be incorporated to achieve the same purpose.

Figure 2A:
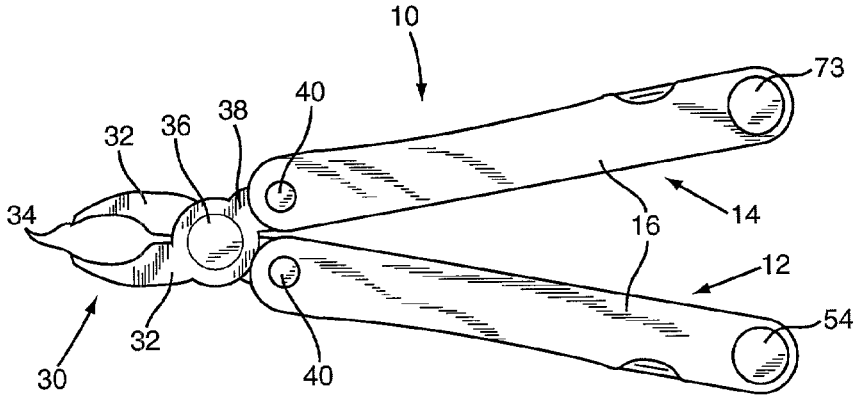
FIG. 2A is a side elevational view of the candle tool shown in an open and operative position.

The wick cutter 30, described earlier, is basically used to trim and cut the wick of a candle. In the open and operative position as shown in FIG. 2A, the wick cutter 30 can be projected downwardly to the top portion of a candle and by opening and squeezing the handles 12 and 14 together, the cutting edges 34 of the wick cutter 30 can be utilized to trim and cut the wick extending from a candle.

Now turning to the wick dipper 56, as noted above, the same includes an L-shaped wire-like terminal end. This candle tool can be used to extinguish a lit wick. In particular, the L-shaped terminal end can be used to engage a lit wick and to push it underneath the melted wax extending around the wick. This results in the wick being extinguished without emitting smoke. Thereafter, the L-shaped wick dipper 60 can be used to retrieve and pull the wick back up from underneath the melted wax.

The match holder 50 and particularly the alligator clip 52 can be utilized to hold a match. This, of course, can be used to light a candle.

The scoop 64 enables one to dig or scoop down into the debris surrounding the wick. More particularly, by using the scoop 64, one can dig debris and wax from in and around the wick and in the process can expose more wick and thus make the candle easier to light.

The digger indicated generally by the numerals 70 and which in the embodiment illustrated herein is mounted adjacent the scoop 64, is used to loosen wax and debris around the wick. Ordinarily, one would use the digger 70 prior to utilizing the scoop 64. That is, by utilizing the digger 70, debris and wax can be loosed or broken away from the candle and thereafter scooped and removed by the scoop 64.

FIG. 2A shows the candle tool 10 in an open position but with the individual tools secured to pivot shafts 54 and 73 disposed in a stored or inoperative position. Here, the wick cutter 30 projects from the handles and can be used again to trim the wick.

Figure 2B:
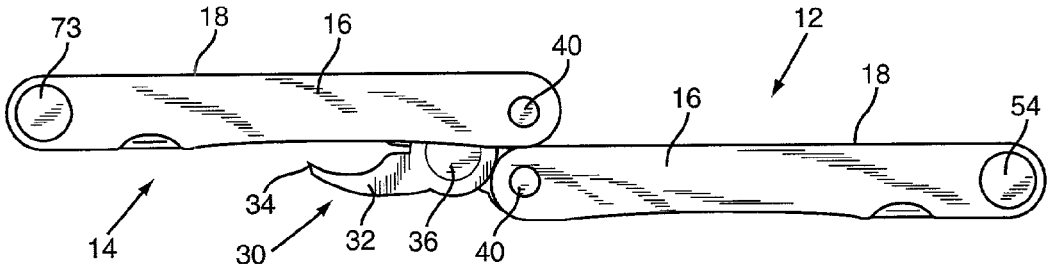
FIG. 2B is a side elevational view of the candle tool with the individual handles being extended such that they extend in general parallel relationship.

In many cases, prior to using the other tools, that is the tools secured about pivot shafts 54 and 73, the two handles 12 and 14 can be disposed such that they form an elongated tool. That is, as illustrated in FIG. 2B, the upper handle 14 can be rotated counterclockwise to where it extends generally parallel with the other handle, handle 12. In this position, the individual tools can be extended from the opposite ends of the two handles. Also, it is appreciated that when the upper handle 14 is rotated to where it extends generally parallel with the other handle 12 that a portion of the wick cutter 30 would lie within the channel 20 of the handle 14. In this configuration, the handle 10 is easy to handle and use and the individual tools, other than the wick cutter 30 are disposed at opposite extremes of the handle structure as configured in this situation.

Figure 2C:
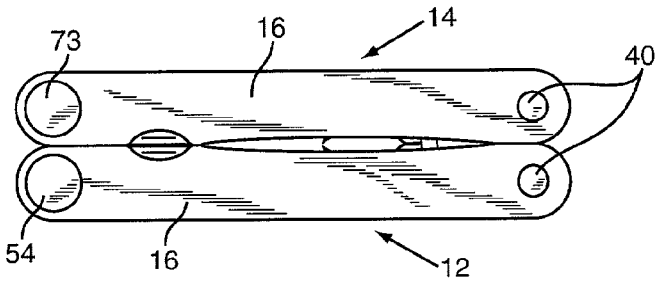
FIG. 2C is a side elevational view of the candle tool shown in a folded position.

Finally, the entire handle structure 10 can be folded to a closed position as shown in FIG. 2C. In this mode, it is appreciated that all of the candle tools including the wick cutter 30 are housed within the channels 20 of the handles 12 and 14. This makes the entire candle tool compact, easy to handle and easy to carry.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A foldable candle tool having a plurality of candle tools incorporated therein, comprising: a foldable handle structure moveable between a folded and closed position and an open and operative position; a series of candle tools mounted to the foldable handle structure with each tool being moveable from a storage position contained within the handle to an open operative position where the respective tools project outside of the handle structure; wherein the candle tools include at least two candle tools taken from the group including a wick cutter, wick dipper, match holder, candle digger, lighter, swab, and a retractable wick; and wherein the foldable candle tool includes a wick dipper, the wick dipper includes an arm secured to one handle of the candle tool and a generally L-shaped wire secured to a terminal end of the arm and extending therefrom.

2. The foldable candle tool of claim 1 wherein the foldable handle structure includes a pair of handles that are adapted to be disposed in an extended position where the respective handles are disposed in general parallel relationship to each other.

3. The foldable candle tool of claim 1 wherein the handle structure includes a pair of handles and a wick cutter, and wherein the wick cutter includes a pivot joint and a pair of legs with each leg being pivotally connected to one end of the respective handles.

4. The foldable candle tool of claim 3 wherein in the folded position the wick cutter is housed with both handles.

5. The foldable candle tool of claim 3 wherein the wick cutter includes a pair of jaws that are pivotally connected about a pivot pin and a pair of legs with each leg being pivotally connected to an end portion of the handle structure.

6. The foldable candle tool of claim 1 wherein the handle structure includes a pair of handles with each handle having an open channel formed on one side thereof; and wherein one or more of the series of candle tools are pivotally connected to one end of at least one handle such that in the stored position, the candle tools assume a position within the channel of one of the respective handles.

7. The foldable candle tool of claim 1 including a wick cutter, a wick dipper for engaging a candle wick and submerging the candle wick within melted wax to extinguish the candle wick, and a match holder for engaging and holding a match.

8. The foldable candle tool of claim 7 further including a candle scoop for scooping wax and debris formed in and around a candle wick and a candle digger for digging into the wax of a candle in and around the wick.

9. The foldable candle tool of claim 1 wherein one of the candle tools includes a pre-fueled lighter.

10. The foldable candle tool of claim 1 wherein one of the candle tools includes a sleeve having an extendable and retractable wick incorporated therein where the wick functions to light a candle.

11. The foldable candle tool of claim 1 wherein one of the candle tools includes a sleeve adapted to receive a swab and wherein the sleeve is provided with an actuator that is effective to extend and retract the swab from the sleeve.

12. The foldable candle tool of claim 11 wherein the swab is disposable.

13. The foldable candle tool of claim 1 wherein the candle tool includes at least three candle tools taken from the group including a wick cutter, wick dipper, match holder, candle digger, lighter, swab, and a retractable wick.

14. The foldable candle tool of claim 1 wherein the candle tool includes at least four candle tools taken from the group including a wick cutter, wick dipper, match holder, candle digger, lighter, swab, and a retractable wick.

15. A foldable candle tool having a series of tools for operating on a candle, comprising:

a. a pair of handles with each handle having an open channel formed therein;

b. a wick cutter having a pair of jaws pivotally connected about a pivot pin and including a pair of legs;

c. each of the legs of the wick cutter being pivotally connected to one end of one handle such that the handles are effectively coupled together by the wick cutter;

d. the handles being moveable between a closed position where the open channels of each handle face each other and the wick cutter is at least partially housed within opposed channels, and an open position where the wick cutter projects from the two handles; and e. a plurality of candle tools moveably mounted to the handles with each candle tool moveable from a stored position within one channel to a position where the candle tool projects outwardly from the handle;

f. wherein the plurality of candle tools include at least two tools taken from the group including a wick dipper, match holder, candle scoop, candle digger, pre-fuel lighter, wick lighter, and an extendable swab; and g. wherein the plurality of tools includes a wick dipper pivotally connected to one handle, the wick dipper including an arm and a generally L-shaped wire secured to the arm and extending therefrom.

16. The foldable candle tool of claim 15 wherein each of the plurality of candle tools are pivotally connected to respective handles.

17. The foldable candle tool of claim 15 wherein the plurality of candle tools includes a wick dipper, an alligator clip, and a candle scoop.

18. The foldable candle tool of claim 15 wherein the plurality of candle tools includes at least two candle tools pivotally connected to the end of one handle opposite the end where the wick cutter is connected, and at least two other candle tools pivotally connected to the end of the other handle opposite the end where the wick cutter is connected.

* * * * *